US010859033B2

(12) United States Patent
Matsuo et al.

(10) Patent No.: US 10,859,033 B2
(45) Date of Patent: Dec. 8, 2020

(54) PISTON HAVING AN UNDERCROWN SURFACE WITH INSULATING COATING AND METHOD OF MANUFACTURE THEREOF

(71) Applicant: Federal-Mogul LLC, Southfield, MI (US)

(72) Inventors: Eduardo Matsuo, Ann Arbor, MI (US); Warran Boyd Lineton, Chelsea, MI (US)

(73) Assignee: Tenneco Inc., Lake Forest, IL (US)

( * ) Notice: Subject to any disclaimer, the term of this patent is extended or adjusted under 35 U.S.C. 154(b) by 383 days.

(21) Appl. No.: 15/598,564

(22) Filed: May 18, 2017

(65) Prior Publication Data

US 2017/0335792 A1 Nov. 23, 2017

Related U.S. Application Data

(60) Provisional application No. 62/339,053, filed on May 19, 2016.

(51) Int. Cl.
*F02F 3/10* (2006.01)
*C23C 30/00* (2006.01)
(Continued)

(52) U.S. Cl.
CPC ..... *F02F 3/10* (2013.01); *C23C 30/00* (2013.01); *F02F 3/0069* (2013.01); *F02F 3/18* (2013.01);
(Continued)

(58) Field of Classification Search
CPC ..... F02F 3/0069; F02F 3/0084; F02F 3/10; F02F 3/18; F02F 2200/00; F02B 77/11; F05C 2251/048
(Continued)

(56) References Cited

U.S. PATENT DOCUMENTS 1,559,439 A * 10/1925 Kapraun ..... F02B 77/02 123/668
4,450,610 A * 5/1984 Schaper ..... B29C 53/76 156/173
(Continued)

FOREIGN PATENT DOCUMENTS

GB 2307193 A 5/1997
JP H0457650 U 5/1992
(Continued)

OTHER PUBLICATIONS

Klod Kokini and Sudarshan V. Rangaraj, Time-Dependent Behavior and Fracture of Functionally Graded Thermal Barrier Coatings Under Thermal Shock, Aug. 15, 2005, Trans Tech Publications, Material Science Forum, ISSN: 1662-9752, vols. 492-493, pp. 379-384 (Year: 2005).*
(Continued)

*Primary Examiner* — John M Zaleskas
(74) *Attorney, Agent, or Firm* — Robert L. Stearns; Dickinson Wright, PLLC

(57) ABSTRACT

A vehicle internal combustion piston and method of construction thereof are provided. The piston includes piston body extending along a central longitudinal axis, having an upper combustion wall forming an upper combustion surface and an undercrown surface opposite the upper combustion surface. An annular ring belt region depends from the upper combustion surface, a pair of skirt panels depend from the ring belt region, and a pair of pin bosses depend from the undercrown surface to provide laterally spaced pin bores aligned along a pin bore axis for receipt of a wrist pin. The undercrown surface forms a central undercrown surface, and a portion of either an open outer cooling gallery, a sealed outer cooling gallery, or an outer galleryless region,
(Continued)

wherein an insulating coating is applied to at least one of the portions of the undercrown surface.

24 Claims, 8 Drawing Sheets

(51) Int. Cl.
*F02F 3/00* (2006.01)
*F02F 3/18* (2006.01)

(52) U.S. Cl.
CPC ..... *F02F 2200/00* (2013.01); *F05C 2251/048* (2013.01)

(58) Field of Classification Search
USPC ..... 123/41.35, 193.6, 668
See application file for complete search history.

(56) References Cited

U.S. PATENT DOCUMENTS 4,599,270 A 7/1986 Rangaswamy et al.
4,610,967 A 9/1986 Imanishi et al.
4,712,600 A * 12/1987 Hamajima ..... B22D 19/0027 164/108
4,891,343 A * 1/1990 Quadair ..... C01G 25/02 501/103
4,977,114 A * 12/1990 Horinouchi ..... C04B 35/486 501/103
5,063,894 A * 11/1991 Mielke ..... C22C 23/06 123/193.6
5,174,193 A * 12/1992 Parker ..... F02F 3/0015 123/193.6
5,236,787 A * 8/1993 Grassi ..... B22F 7/04 428/539.5
5,320,909 A * 6/1994 Scharman ..... C23C 4/02 415/174.4
5,384,200 A 1/1995 Giles et al.
5,455,000 A * 10/1995 Seyferth ..... B22F 7/04 419/10
5,658,837 A * 8/1997 Quadir ..... C01G 25/02 501/103
5,722,379 A * 3/1998 Binder ..... C23C 4/06 123/668
6,117,560 A * 9/2000 Maloney ..... C23C 14/083 428/472
6,513,477 B1 * 2/2003 Gaiser ..... F02F 3/003 123/193.6
6,656,600 B2 12/2003 Strangman et al.
8,053,089 B2 11/2011 Margolies et al.
8,877,031 B2 11/2014 Suda et al.
9,127,619 B2 * 9/2015 Lineton ..... F02F 3/16
9,163,579 B2 10/2015 Aharonov et al.
9,169,800 B2 10/2015 Matsuo
2003/0051694 A1 * 3/2003 Gaiser ..... F02F 3/003 123/193.6
2007/0113802 A1 * 5/2007 Mihara ..... F02F 3/12 123/41.35
2008/0167403 A1 * 7/2008 Burkle ..... C09D 183/04 524/1
2010/0236516 A1 * 9/2010 Sasaki ..... C10M 111/04 123/193.6
2011/0030645 A1 * 2/2011 Rebello ..... F02F 3/003 123/193.6
2011/0048017 A1 3/2011 Margolies et al.
2012/0082841 A1 * 4/2012 Kadoshima ..... F02B 77/11 428/312.6
2012/0118255 A1 * 5/2012 Jung ..... C09D 161/06 123/193.6
2012/0258266 A1 * 10/2012 Koban ..... C23C 28/321 428/34.1
2013/0133609 A1 * 5/2013 Matsuo ..... F02F 3/10 123/193.6
2013/0180494 A1 * 7/2013 Aharonov ..... F02F 3/10 123/193.6
2013/0189441 A1 * 7/2013 Pabla ..... C23C 4/12 427/453
2013/0205991 A1 * 8/2013 Sasaki ..... F16J 1/08 92/153
2014/0123930 A1 * 5/2014 Lineton ..... F02F 3/16 123/193.6
2015/0030871 A1 * 1/2015 Bruck ..... C23C 24/106 428/547
2015/0104626 A1 * 4/2015 Tomita ..... C09D 1/00 428/213
2015/0204269 A1 * 7/2015 Hiratsuka ..... F02B 77/11 123/193.3
2016/0130519 A1 5/2016 Zhao et al.
2017/0138296 A1 * 5/2017 Matsuo ..... B05D 5/00
2017/0145914 A1 * 5/2017 Lineton ..... F02B 77/11
2017/0145952 A1 * 5/2017 Lineton ..... C23C 4/02
2017/0241371 A1 * 8/2017 Schneider ..... C23C 4/11
2017/0268457 A1 * 9/2017 Azevedo ..... F02B 23/0603
2017/0284334 A1 * 10/2017 Lineton ..... F02F 3/0015
2018/0128166 A1 * 5/2018 Lineton ..... F02F 3/12
2018/0216524 A1 * 8/2018 Lineton ..... C23C 28/32
2018/0236555 A1 * 8/2018 Weinenger ..... B22F 3/1055
2019/0211774 A1 * 7/2019 Schneider ..... C23C 28/321

FOREIGN PATENT DOCUMENTS

JP 2014034917 A * 2/2014
JP 2014034917 A 2/2014
WO 2017087433 A1 5/2017

OTHER PUBLICATIONS

Handbook of Thermal Spray Technology, Introduction to Thermal Spray Processing, 2004, ASM International, pp. 3-13 (Year: 2004).*
International Search Report, dated Aug. 2, 2017 (PCT/US2017/033444).
M. B. Beardsley, Final Report of Thick Thermal Barrier Coatings (TTBCs) for Low Emmission, High Efficiency Diesel Engine Components, Prepared for Assistant Secretary for Energy Efficiency and Renewable Energy, Office of Transportation Technologies As part of the Ceramic Technology Project of the Materials, Development Program, under contract FC05-970R22580, Mar. 26, 2006, 144 pages.
Ralph A. Corvino, Ceramic Coating Diesel Engine Combustion Components, 1989, pp. 43-44.

* cited by examiner

PISTON HAVING AN UNDERCROWN SURFACE WITH INSULATING COATING AND METHOD OF MANUFACTURE THEREOF

CROSS-REFERENCE TO RELATED APPLICATION

This application claims the benefit of U.S. Provisional Application Ser. No. 62/339,053, filed May 19, 2016, which is incorporated herein by reference in its entirety.

BACKGROUND OF THE INVENTION

1. Field of the Invention

This invention relates generally to pistons for internal combustion engines, and methods for manufacturing the pistons.

2. Related Art

Pistons used in internal combustion engines, such as heavy duty diesel pistons, are exposed to extremely high temperatures during operation, especially along the crown of the piston. Engine and piston manufacturers typically attempt to control the temperature of the crown and reduce heat loss from the combustion chamber to the crown, in order to maintain usable fuel energy and high gas temperature inside the combustion chamber, and to achieve a higher engine break thermal efficiency (BTE).

To moderate the temperature of the crown, some pistons are designed with a cooling gallery beneath the crown, wherein cooling oil is sprayed into the cooling gallery and onto an undercrown surface as the piston reciprocates along a cylinder bore of the engine. The oil flows along the inner surface of the cooling gallery and dissipates heat from the crown. However, to control the piston temperature during operation, a high flow of oil must be constantly maintained, which adds to the parasitic losses, which in turn reduces the engine fuel efficiency. In addition, the oil degrades over time due to the high temperature of the internal combustion engine, and thus, the oil must be changed periodically to maintain adequate engine life. Furthermore, when the piston cooling gallery and/or undercrown temperature is exposed to high temperatures over a prolonged period of time, the oil tends to coke at an increased rate, and resulting deposits of coked oil may buildup on the inner surface of the cooling gallery and/or on the undercrown.

Another way to control the temperature of the crown is to design the piston with a sealed cooling gallery containing coolant media which are more heat resistant than oil when exposed to high temperatures. U.S. Pat. No. 9,127,619 discloses an example of a piston including a sealed cooling gallery partially filled with a liquid containing metal particles having a high thermal conductivity. The liquid carries the metal particles throughout the cooling gallery as the piston reciprocates in the internal combustion engine, and the metal particles remove heat from the crown. The metal particles can re-distribute the heat flow, and thus also reduces cooling gallery deposits, and oil degradation.

However, engine and piston manufacturers continuously strive to develop new and improved ways to reduce the temperatures of undercrown and/or cooling gallery surfaces, reduce the build-up of coked oil deposits and carbon on cooling gallery and/or undercrown surfaces, reduce engine oil degradation, and lengthen the time between necessary engine oil change intervals.

SUMMARY OF THE INVENTION

One aspect of the invention provides a piston for an internal combustion engine that exhibits a reduced surface temperature and surface deposits along at least one of an inner surface of a cooling gallery and undercrown of the piston, and a reduced the tendency for degradation of cooling oil.

A piston for an internal combustion engine is provided. The piston includes a metal piston body extending along a central longitudinal axis along which the piston reciprocates in a cylinder bore of an internal combustion engine. The piston body has an upper combustion wall forming an upper combustion surface configured for direct exposure to combustion gases within the cylinder bore and an undercrown surface opposite the upper combustion surface. An annular ring belt region depends from the upper combustion surface for receipt of at least one piston ring, and a pair of skirt panels depend from the ring belt region to facilitate guiding the piston within the cylinder bore. A pair of pin bosses depend from the undercrown surface, with the pin bosses providing a pair of laterally spaced pin bores aligned along a pin bore axis for receipt of a wrist pin. The undercrown surface of the piston body forms a central undercrown surface, and a portion of either an open outer cooling gallery, a sealed outer cooling gallery, or an outer galleryless region, wherein an insulating coating is applied to at least one of the portions of the undercrown surface.

In accordance with another aspect of the invention, the insulating coating has a thermal conductivity which is lower than the thermal conductivity of the piston body.

In accordance with another aspect of the invention, the insulating coating is formed of one of a ceramic-based material or polymer-based material.

In accordance with another aspect of the invention, the insulating coating can be formed of a ceramic-based material including at least one of ceria, ceria stabilized zirconia, and ceria/yttria stabilized zirconia.

In accordance with another aspect of the invention, the insulating coating can include ceria in an amount of 90 to 100 wt. %, based on the total weight of the ceramic-based material.

In accordance with another aspect of the invention, the insulating coating can include ceria stabilized zirconia in an amount of 90 to 100 wt. %, based on the total weight of the ceramic-based material.

In accordance with another aspect of the invention, the insulating coating can include ceria/yttria stabilized zirconia in an amount of 90 to 100 wt. %, based on the total weight of the ceramic-based material.

In accordance with another aspect of the invention, about 50 wt. % of the zirconia can be stabilized by ceria and about 50 wt. % of the zirconia can be stabilized by yttria, based on the total weight of the ceramic-based material.

In accordance with another aspect of the invention, a metal-based bond material can be sandwiched between the metal piston body and the insulating material to facilitate bonding the insulating material to the metal piston body.

In accordance with another aspect of the invention, the metal-based bond material can be formed from the same type of metal as the metal piston body.

In accordance with another aspect of the invention, the metal-based bond material can be formed from a superalloy.

In accordance with another aspect of the invention, the metal-based bond material can form a gradient transitioning from 100% metal-based bond material to a 100% ceramic-based material.

In accordance with another aspect of the invention, the insulating coating can have a thermal conductivity less than 1 W/m·K.

In accordance with another aspect of the invention, the piston can be formed having an open cooling gallery with an inlet configured for oil to be sprayed in the open cooling gallery and an outlet configured for the oil to exit the open cooling gallery, wherein the insulating coating is applied to at least a portion of the open cooling gallery.

In accordance with another aspect of the invention, the piston can be formed having a closed cooling gallery, wherein the insulating coating is applied to at least a portion of the closed cooling gallery.

In accordance with another aspect of the invention, the piston can be formed having an outer galleryless region, wherein the insulating coating is applied to at least a portion of the outer galleryless region.

In accordance with another aspect of the invention, a method of manufacturing a piston for an internal combustion engine is provided. The method includes forming a metal piston body extending along a central longitudinal axis along which the piston reciprocates in a cylinder bore of an internal combustion engine and forming the piston body having an upper combustion wall providing an upper combustion surface configured for direct exposure to combustion gases within the cylinder bore and providing an undercrown surface opposite the upper combustion surface. Further, providing the piston body with an annular ring belt region depending from the upper combustion surface for receipt of at least one piston ring. Further, providing the piston body with a pair of skirt panels depending from the ring belt region to facilitate guiding the piston within the cylinder bore. Further, providing the piston body with a pair of pin bosses depending from the undercrown surface to provide a pair of laterally spaced pin bores aligned along a pin bore axis for receipt of a wrist pin. Further yet, forming the undercrown surface to provide a central undercrown surface and either a portion of an open outer cooling gallery, a portion of a sealed outer cooling gallery, or a portion of an outer galleryless region. Further yet, applying an insulating coating to at least one of the portions of the undercrown surface.

In accordance with another aspect of the invention, the method includes providing the insulating coating having a thermal conductivity which is lower than the thermal conductivity of the piston body.

In accordance with another aspect of the invention, the method can include providing the insulating coating being one of a ceramic-based material or polymer-based material.

In accordance with another aspect of the invention, the method can include providing the insulating coating being formed of a ceramic-based material including at least one of ceria, ceria stabilized zirconia, and ceria/yttria stabilized zirconia.

In accordance with another aspect of the invention, the method can include providing the insulating coating including ceria in an amount of 90 to 100 wt. %, based on the total weight of the ceramic-based material.

In accordance with another aspect of the invention, the method can include providing the insulating coating including ceria stabilized zirconia in an amount of 90 to 100 wt. %, based on the total weight of the ceramic-based material.

In accordance with another aspect of the invention, the method can include providing the insulating coating including ceria/yttria stabilized zirconia in an amount of 90 to 100 wt. %, based on the total weight of the ceramic-based material.

In accordance with another aspect of the invention, the method can include providing about 50 wt. % of the zirconia being stabilized by ceria and about 50 wt. % of the zirconia being stabilized by yttria, based on the total weight of the ceramic-based material.

In accordance with another aspect of the invention, the method can include applying a metal-based bond material in sandwiched relation between the metal piston body and the insulating material to facilitate bonding the insulating material to the metal piston body.

In accordance with another aspect of the invention, the method can include providing the metal-based bond material being formed from the same type of metal as the metal piston body.

In accordance with another aspect of the invention, the method can include providing the metal-based bond material being formed from a superalloy.

In accordance with another aspect of the invention, the method can include applying the metal-based bond material to form a gradient transitioning from 100% metal-based bond material to a 100% ceramic-based material.

In accordance with another aspect of the invention, the method can include providing the insulating coating having a thermal conductivity less than 1 W/m·K.

In accordance with another aspect of the invention, the method can include forming the piston having an open cooling gallery with an inlet configured for oil to be sprayed in the open cooling gallery and an outlet configured for the oil to exit the open cooling gallery, and applying the insulating coating to at least a portion of the open cooling gallery.

In accordance with another aspect of the invention, the method can include forming the piston having a closed cooling gallery, and applying the insulating coating to at least a portion of the closed cooling gallery.

In accordance with another aspect of the invention, the method can include forming the piston having an outer galleryless region, and applying the insulating coating to at least a portion of the outer galleryless region.

BRIEF DESCRIPTION OF THE DRAWINGS

These and other aspects, features and advantages of the invention will become more readily appreciated when considered in connection with the following detailed description, appended claims and accompanying drawings, in which:

DETAILED DESCRIPTION OF PRESENTLY PREFERRED EMBODIMENTS

Figure 1:
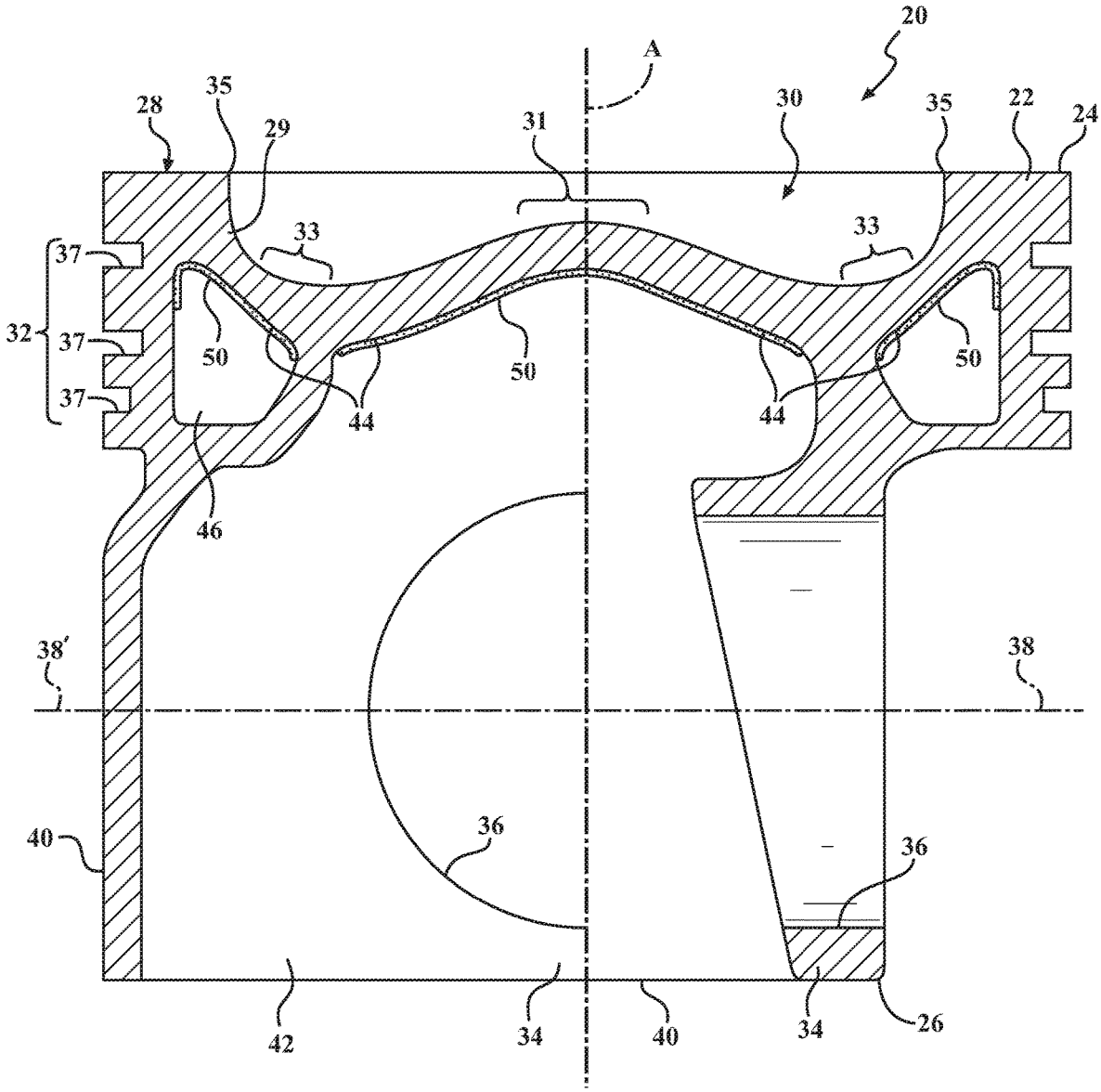
FIG. 1 is a dual cross-sectional side view of a piston constructed in accordance with one aspect of the invention shown taken generally transversely to a pin bore axis to the left of axis A, and shown taken generally along the pin bore axis to the right of axis A.

Referring in more detail the drawings, FIGS. 1, 1A-3 illustrate respective pistons 20, 20', 20", 20'" for an internal combustion engine according to different example embodiments of the invention. The pistons 20, 20', 20", 20'" are discussed hereafter using the same reference numerals to identify like features. The pistons 20, 20', 20", 20'" each have a body 22 formed of a metal material, such as steel extending along a center axis A, along which the pistons 20, 20', 20", 20'" reciprocate in use, from an upper end 24 to a lower end 26. The body 22 of the pistons 20, 20', 20", 20'" include a crown 28 at the upper end 24 of an upper combustion wall 29, wherein the crown 28 is directly exposed to a combustion chamber and hot gases therein during use, with a combustion bowl 30 depending therein.

In the example embodiments, the combustion bowl 30 of the body 22 presents an apex region 31 about the center axis A, a concave, toroidal bowl-shaped valley region 33 surrounding the center axis A, and a bowl-rim 35 surrounding the valley 33. An annular ring belt 32 depends from the crown 28 to present a plurality of ring grooves 37 facing away from the center axis A and extending circumferentially around the center axis A.

The pistons 20, 20', 20", 20'" further include a lower part presenting a pair of pin bosses 34, each depending from the crown 28, having pin bores 36 aligned with one another along a pin bore axis 38 extending perpendicular to the center axis A for receiving a wrist pin (not shown). The body 22 also includes a pair of diametrically opposite skirt panels 40 depending from the crown 28 and extending along a circumferential direction partially about the center axis A along opposite sides of the pin bore axis 38. The skirt panels 40 are joined to the pin bosses 34 via strut portions 42. It is noted that the body 22 of the pistons 20, 20', 20", 20'" could comprise various other designs and features than those shown in FIGS. 1, 1A-3.

Figure 1A:
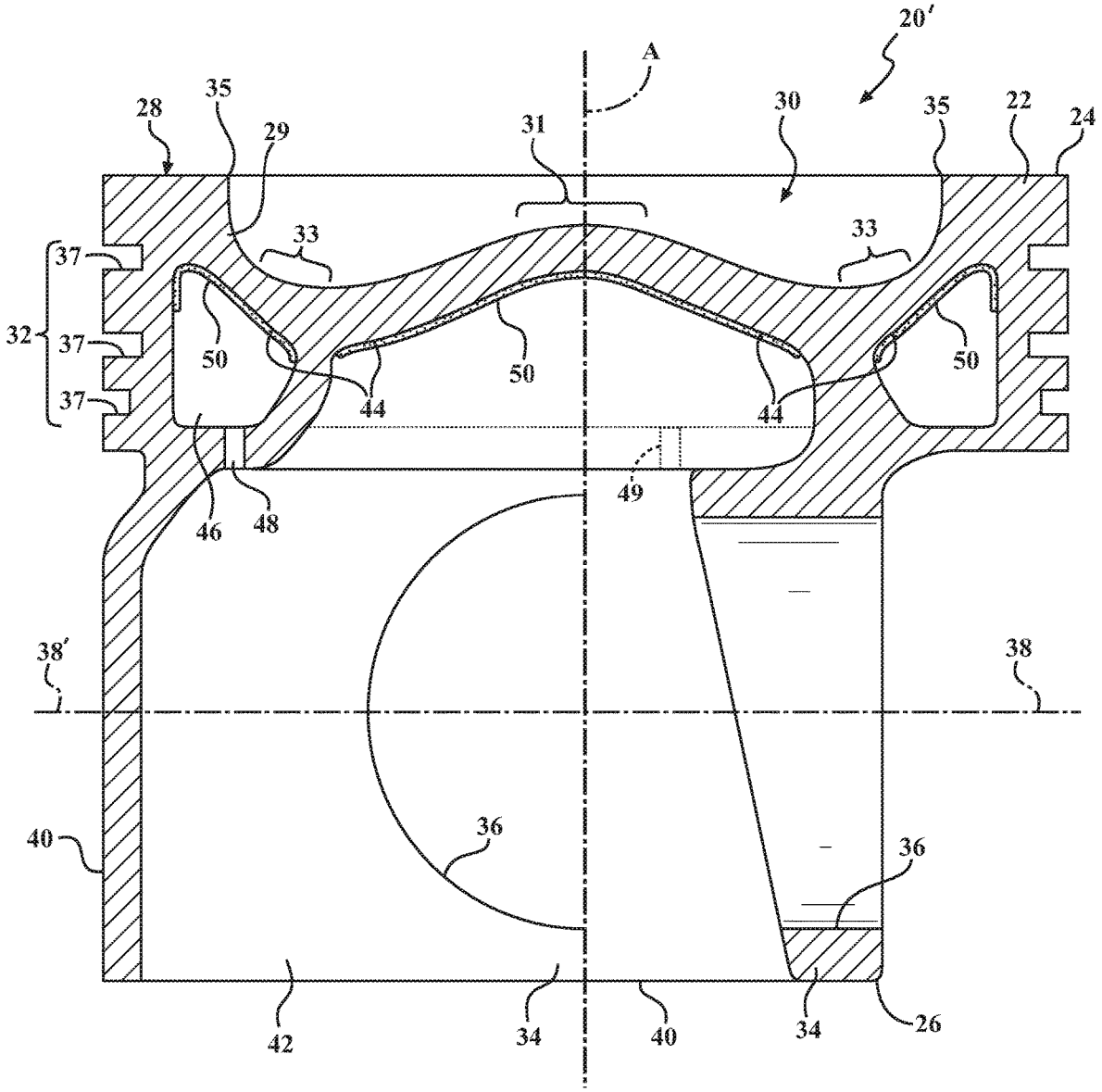
FIG. 1A is a view similar to FIG. 1 of a piston constructed in accordance with another aspect of the invention.

The lower part of the body 22 of the piston 20 also presents an undercrown surface 44 on an opposite side of the upper combustion wall 29 from the crown 28, and facing opposite the combustion bowl 30. The piston 20 can optionally include an outer cooling gallery 46 in addition to the undercrown surface 44, as shown in FIGS. 1, 1A. In these embodiments, the outer cooling gallery 46 is disposed adjacent the ring belt 32 in radial alignment or substantial radial alignment therewith (substantial is intended to mean that at least a portion of the outer cooling gallery 46 is radially aligned with the ring belt 32, but a portion may not be radially aligned with the ring belt 32), wherein the cooling gallery 46 extends circumferentially around the center axis A. As shown in FIG. 1, the outer cooling gallery 46 can be sealed to contain a cooling media therein, which can be a solid, liquid, and/or gas. According to one embodiment, the sealed outer cooling gallery 46 can be filled with air. Otherwise, as shown in FIG. 1A, the outer cooling gallery 46 can be open, thereby including inlet and outlet openings 48, 49, such that cooling oil from a crankcase can enter and exit the outer cooling gallery 46, such as by being sprayed into the inlet opening 48 and allowed to exit the outlet opening 49. If desired, the inlet and outlet openings 48, 49 can be sealed, for example a plug, adhesive, weld, or braze, with the desired cooling medium disposed therein, to form the sealed cooling gallery of FIG. 1.

In the examples of FIGS. 1 and 1A, the piston 20, 20' includes a central portion of the undercrown surface 44 located along the center axis A and surrounded by the sealed or open outer cooling gallery 46. The central portion of the undercrown surface 44 is open and shown located directly opposite the apex region 31 of the combustion bowl 30 so that cooling oil from the crankcase can be sprayed or splashed onto the central portion of the undercrown surface 44. However, the central portion of the undercrown surface 44 could alternatively be closed or sealed off from direct exposure to the crankshaft region. A further portion of the undercrown surface 44 is formed by the uppermost surfaces of the open or sealed outer cooling gallery 46 opposite the valley region 33.

Figure 2:
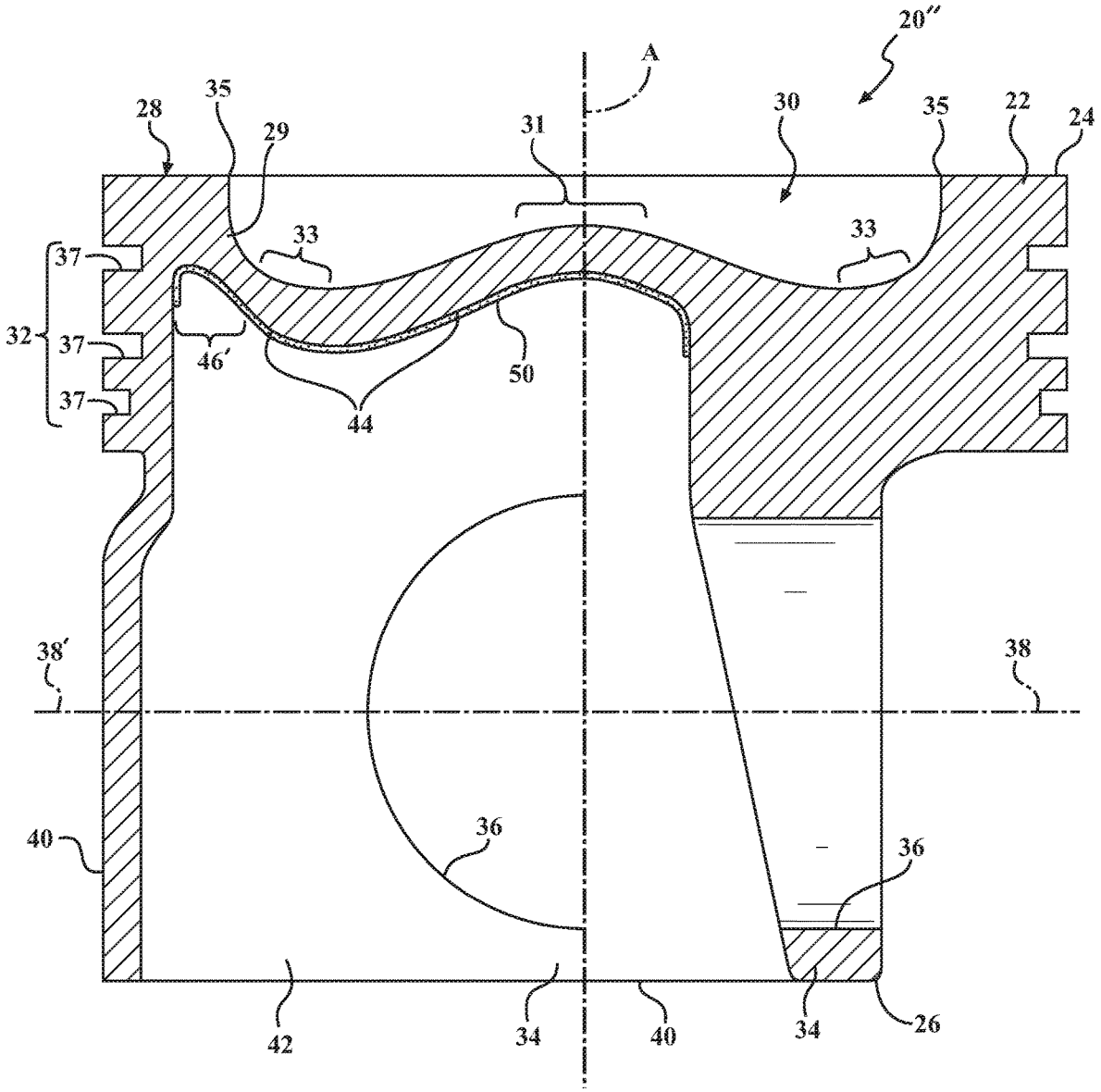
FIG. 2 is a view similar to FIG. 1 of a piston constructed in accordance with another aspect of the invention.

In the example embodiment of FIG. 2, the piston 20" does not include a closed or sealed outer cooling gallery, but instead includes an open outer galleryless region 46' and the central portion of the undercrown surface 44, which are both openly exposed along the lower part of the piston 20". The open galleryless region 46' is shown as extending only along a pair of diametrically opposite regions of the piston 20", wherein one of the regions extends along one side of the pin bore axis 38 generally parallel thereto and generally transversely to a thrust axis axis 38', and the other of the other of the regions extends along another side of the pin bore axis 38 generally parallel thereto and generally transversely to the thrust axis 38'. Accordingly, the open galleryless region 46' is formed to extend along opposite sides of the pin bore axis 38, radially inwardly from the skirt panels 40 and in radial alignment with or substantial radial alignment with the ring belt 32. In the embodiment of FIG. 2, a further outer portion of the undercrown surface 44 is formed by the uppermost surfaces of the outer galleryless region 46', and portions of the pin bosses 34 located above the pin bores 36 and extending to the ring belt 32 are solid piston body material. The central portion of the undercrown surface 44 and the outer portion of the undercrown surface 44 extends from the center axis A to the regions of the ring belt 32 located in axial alignment with the skirt panels 40.

Figure 3:
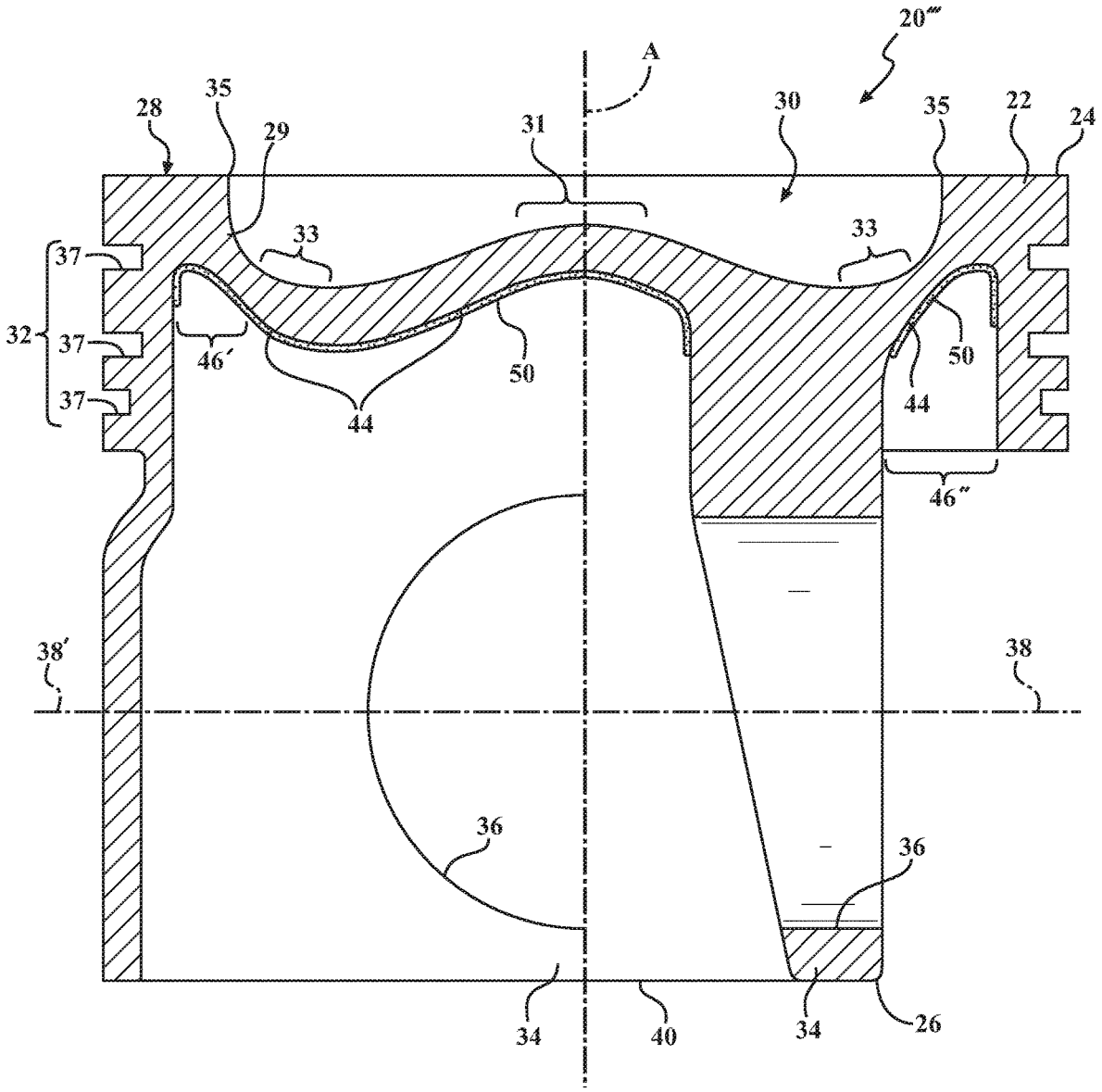
FIG. 3 is a view similar to FIG. 1 of a piston constructed in accordance with yet another aspect of the invention.
Figure 4A:
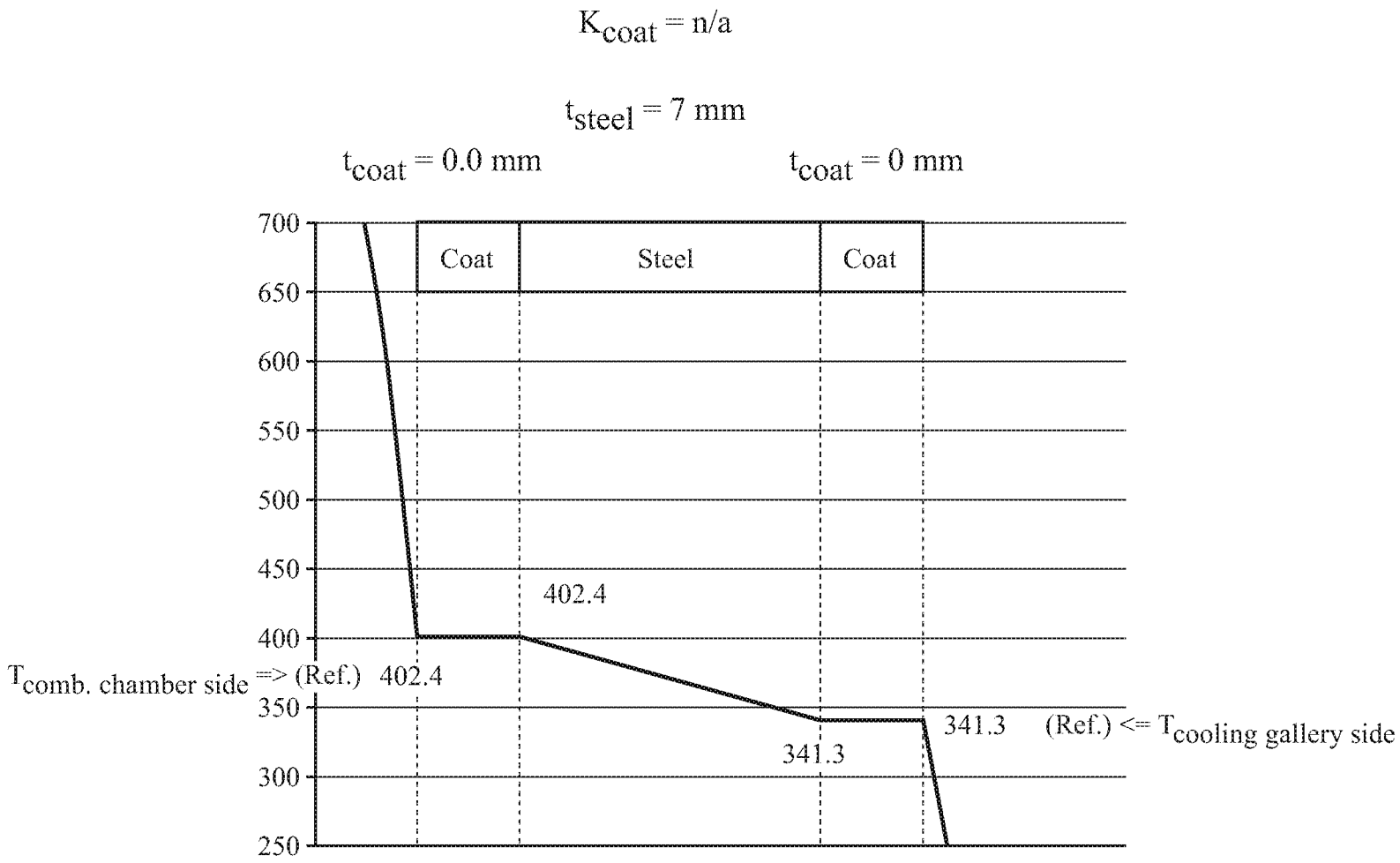
FIGS. 4A-4D depict graphs showing examples of the surface temperatures achieved due to the insulating coating on the cooling gallery and undercrown surfaces of the example embodiments.
Figure 4B:
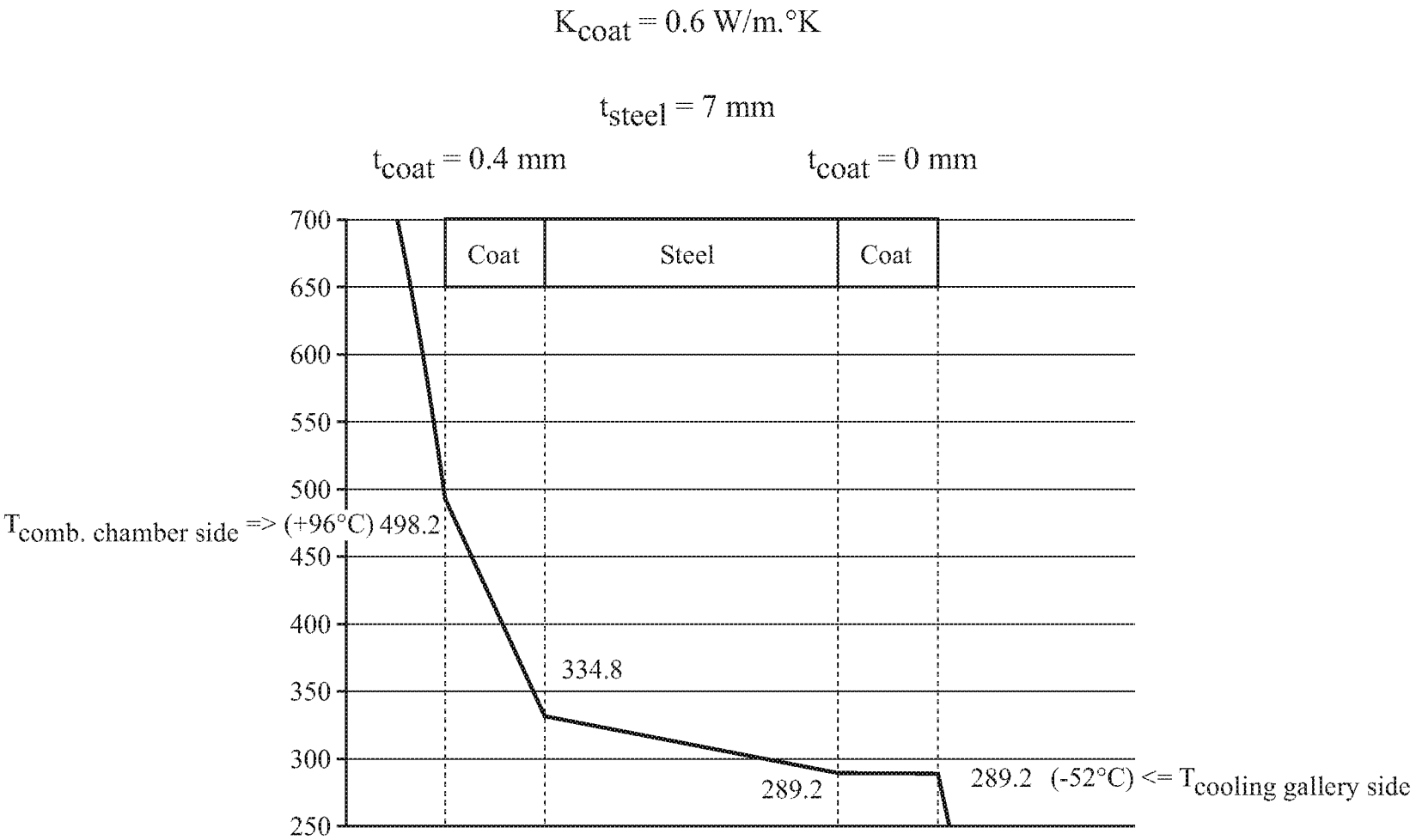
Figure 4C:
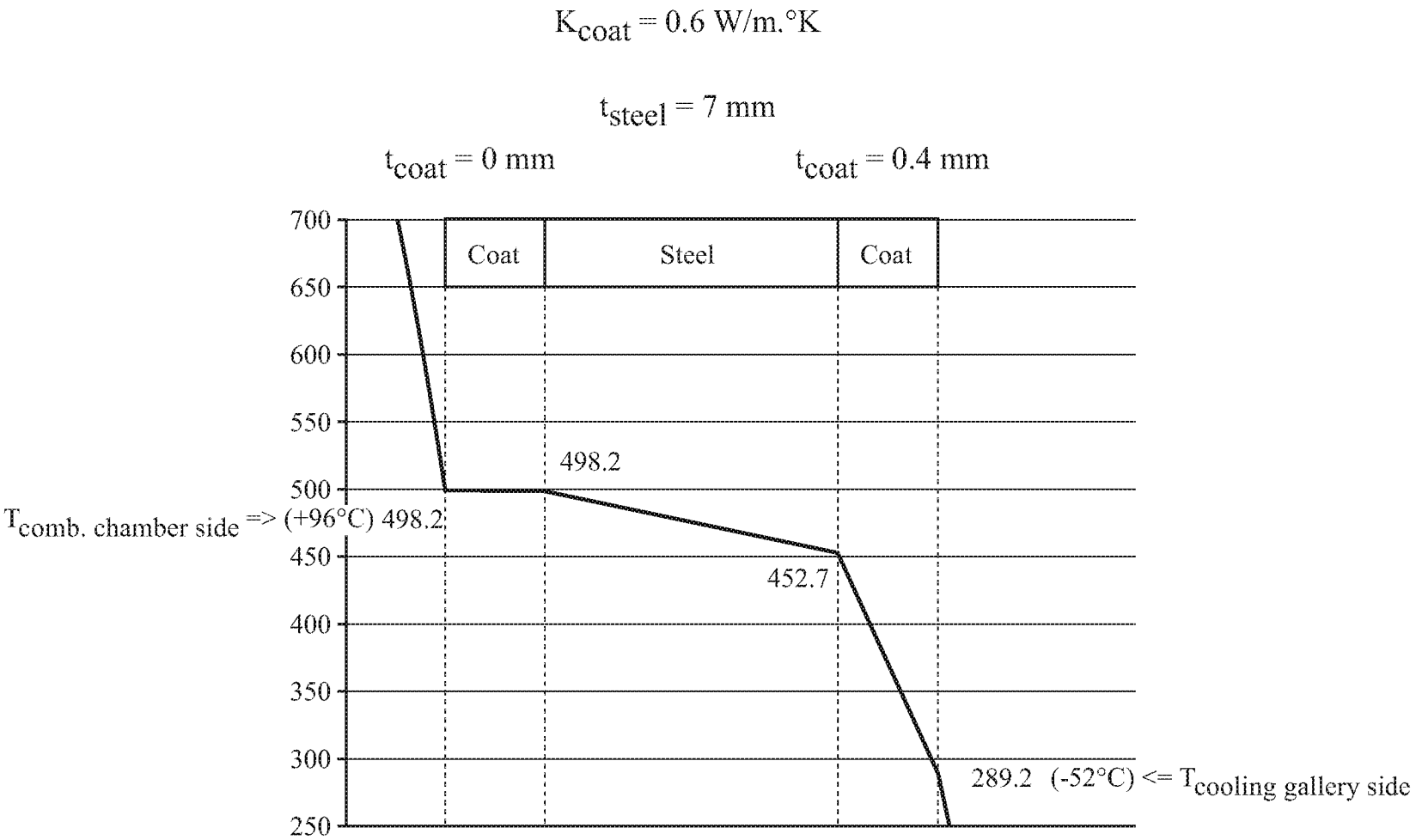
Figure 4D:
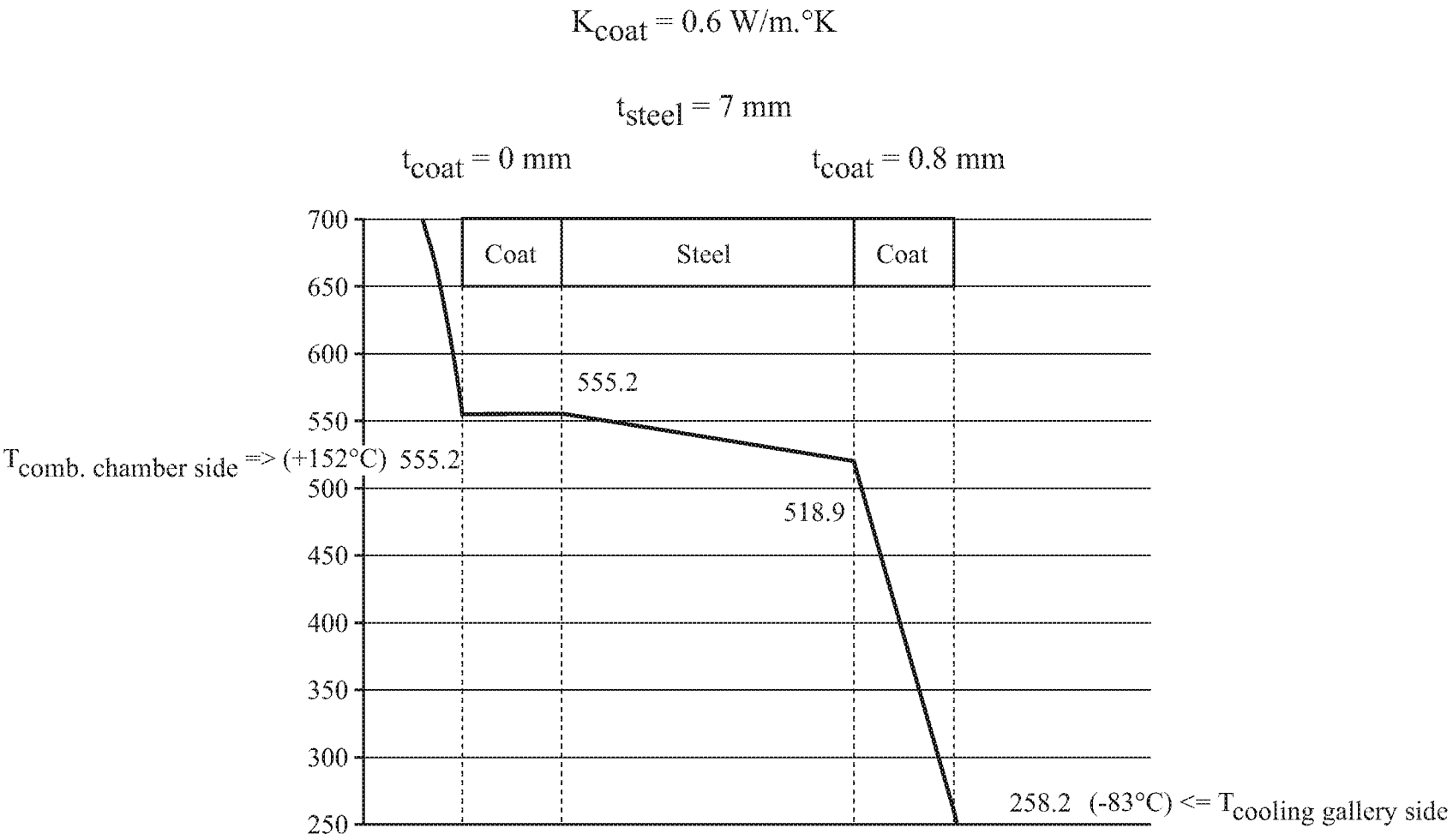

In the embodiment of FIG. 3, the piston 20'" is similar to the piston 20"; however, rather than having an entirely solid piston body portion above and axially aligned with the pin bosses 34, extending to the ring belt 32, a pocket or second open outer galleryless region 46" is located radially outwardly of the pin bosses 34 adjacent and in radial alignment with the ring belt 32. As such, the second open outer galleryless region 46" allows the cooling of the entirety or substantial entirety of the ring belt region 32 to be enhanced via the combined circumferentially continuous configuration provided by the first and second galleryless regions 46', 46". In the embodiment of FIG. 3, the undercrown surface 44 is provided by the combination of the uppermost surfaces/portions of the open galleryless regions 46', 46" generally opposite the valley region 33 of the combustion bowl 30 and the central portion of the undercrown surface 44 opposite the apex region 31 of the combustion bowl 30.

An insulating coating 50 is applied to at least a portion of the undercrown surface 44, and thus, to at least one of the undercrown outer portions provided by the outer cooling gallery 46, and/or outer galleryless regions 46', 46", and/or the central portion of the undercrown surface 44, to reduce the temperature of the surfaces being covered thereby, and thus, reduce carbon deposits and oil coking. At least one layer of the insulating coating 50 is applied, but multiple layers can be applied to reduce surface roughness, fill in porosity, and create anti-stick properties to reduce carbon deposits and oil coking. The insulating coating 50 has a thermal conductivity which is lower than a thermal conductivity of the metal material used to form the piston 20, 20', 20", 20'". Various different compositions can be used to form the insulating coating 50. Typically, the insulating coating 50 is formed of a polymer-based, ceramic-based, or other low thermal conductivity material.

In one example embodiment, the insulating coating 50 includes a polymer based material, including at least one of epoxy, phenolic, fluoropolymer and siloxane materials. The polymer based materials in general have a lower thermal conductivity than piston materials. It is to be recognized that any desired combination of two or more the aforementioned polymer-based materials may be used in combination with one another.

In another example embodiment, the insulating coating 50 includes a ceramic material, specifically at least one of ceria, ceria stabilized zirconia, and ceria/yttria stabilized zirconia. The ceramic material has a low thermal conductivity, such as less than 1 W/m·K. The ceria used in the ceramic material makes the insulating coating 50 more stable under the high temperatures, pressures, and other harsh conditions of the engine. The composition of the ceramic material also makes it less susceptible to chemical attack than other ceramic coatings, such as coatings formed of yttria stabilized zirconia, which can also be used, but are more prone to delamination, destabilization through thermal effects and chemical attack in diesel combustion engines. Ceria and ceria stabilized zirconia are much more stable under such thermal and chemical conditions. Ceria has a thermal expansion coefficient which is similar to the steel material used to form the piston body 22. The thermal expansion coefficient of ceria at room temperature ranges from 10E−6 to 11E−6, and the thermal expansion coefficient of steel at room temperature ranges from 11E−6 to 14E−6. The similar thermal expansion coefficients help to avoid thermal mismatches that produce stress cracks.

In one embodiment, the ceramic material used to form the insulating coating 50 includes ceria in an amount of 90 to 100 wt. %, based on the total weight of the ceramic material. In another example embodiment, the ceramic material includes ceria stabilized zirconia in an amount of 90 to 100 wt. %, based on the total weight of the ceramic material. In yet another example embodiment, the ceramic material includes ceria/yttria stabilized zirconia in an amount of 90 to 100 wt. %, based on the total weight of the ceramic material. In this embodiment, about 50 wt. % of the zirconia is stabilized by ceria and about 50 wt. % of the zirconia is stabilized by yttria, based on the total weight of the ceramic material.

The insulating coating 50 can be applied in a gradient structure to avoid discrete metal/ceramic interfaces. The gradient structure helps to mitigate stress build up through thermal mismatches and reduces the tendency to form a continuous weak oxide boundary layer at the bond material/ceramic interface. In other words, the gradient structure avoids sharp interfaces. Thus, the insulating coating 50 is less likely to de-bond during service.

The gradient structure of the insulating coating 50 is formed by first applying a metal bond material to at least a portion of the undercrown surface 44 provided by the central portion or the undercrown surface 44, and/or the outer cooling gallery 46, and/or the outer galleryless region 46', 46". The composition of the metal bond material can be the same as the material used to form the body 22 of the piston 20, 20', 20", 20'" for example a steel powder. Alternatively the metal bond material can comprise a high performance superalloy, such as those used in coatings of jet turbines. The gradient structure is formed by gradually transitioning from 100% metal bond material to 100% ceramic material. The insulating coating 50 includes the metal bond material applied to the desired portion(s) of the undercrown surface 44, and followed by increasing amounts of the ceramic material and reduced amounts of the metal bond material. The uppermost portion of the insulating coating 50 is formed entirely of the ceramic material.

The insulating coating 50 has been found to adhere well to the steel piston body 22. However, for additional mechanical anchoring, broken edges, such as pockets, recesses, rounded edges, and/or chamfers can be machined along the undercrown surface 44. These features help to avoid stress concentrations in the insulating coating 50 and avoid sharp corners or edges that could cause failure of the insulating coating 50. The machined pockets or recesses mechanically lock the insulating coating 50 in place, again reducing the probability of delamination failure.

The insulating coating 50 can reduce the temperature of the undercrown surface 44 and thus the temperature of the lower part of the body 22 of the piston 20, 20', 20", 20'". The insulating coating 50 can also minimize deposits, minimize oil degradation in the engine, and/or reduce heat flow through the piston 20, 20', 20", 20'". When the insulating coating 50 is applied to the undercrown surface 44, rather than the combustion bowl surface 30, it has a reduced risk for delamination caused by high temperatures and high temperature variation. FIGS. 4A-4D include graphs showing an example of the reduced heat transfer and temperatures achieved in the piston 20, 20', 20", 20'" due to the insulating coating 50.

Another aspect of the invention provides a method of manufacturing the piston 20, 20', 20", 20'" including the insulating coating 50. The body 22 of the piston 20, 20', 20", 20'", which is typically formed of steel, can be manufactured according to various different methods, such as forging or casting. The body 22 of the piston 20, 20', 20", 20'" can also comprise various different designs, and examples of the designs are shown in FIGS. 1, 1A-3.

The method further includes applying the insulating coating 50 to at least a portion of the undercrown surface 44, including at least a portion of the central portion of the undercrown surface 44, and/or at least a portion of the outer cooling gallery 46, and/or at least a portion of the first and/or second open outer galleryless region 46', 46". Various different methods can be used to apply the insulating coating 50. For example, the insulating coating 50 can be spray coated, plated, cast, or in any way permanently attached the steel body 22 of the piston 20, 20', 20", 20'".

In one embodiment, the insulating coating 50 is applied by thermal spraying. For example, the method can include applying the metal bond material and the ceramic material by a thermal spray technique, such as plasma spraying. High velocity Oxy-Fuel (HVOF) spraying is an alternative that gives a denser coating, but it is a more expensive process. Other methods of applying the insulating coating 50 to the piston 20, 20', 20", 20'" can also be used.

The example method begins by spraying the metal bond material in an amount of 100 wt. % and the ceramic material in an amount of 0 wt. %, based on the total weight of the insulating coating 50. Throughout the spraying process, an increasing amount of ceramic material is added to the composition, while the amount of metal bond material is reduced. Thus, the composition of the insulating coating 50 gradually changes from 100% metal bond material at the piston body 22 to 100% ceramic material at the outermost surface of the insulating coating 50. Multiple powder feeders are typically used to apply the insulating coating 50, and their feed rates are adjusted to achieve the gradient structure. The insulating coating 50 is preferably applied to a thickness of less than 500 microns. The gradient structure of the insulating coating 50 is achieved during the thermal spray process.

Prior to applying the insulating coating 50, the broken edges or features that aid in mechanical locking and reduce stress risers can be machined into the undercrown surface 44 of the piston 20, 20', 20", 20'" to which the insulating coating 50 is applied, for example by turning, milling or any other appropriate means. The undercrown surface 44 is then washed in solvent to remove contamination. The method can also include grit blasting the surface to improve adhesion of the insulating coating 50.

Many modifications and variations of the present invention are possible in light of the above teachings and may be practiced otherwise than as specifically described while remaining within the scope of the claims. It is contemplated that all features of all claims and of all embodiments can be combined with each other, so long as such combinations would not contradict one another.

What is claimed is:

1. A piston for an internal combustion engine, comprising:

a metal piston body extending along a central longitudinal axis along which said piston reciprocates in a cylinder bore of the internal combustion engine, said metal piston body having an upper combustion wall forming an upper combustion surface configured for direct exposure to combustion gases within the cylinder bore and an undercrown surface opposite said upper combustion surface, with an annular ring belt region depending from said upper combustion surface for receipt of at least one piston ring;

a pair of skirt panels depending from said ring belt region to facilitate guiding the piston within the cylinder bore;

a pair of pin bosses depending from said undercrown surface, said pin bosses providing a pair of laterally spaced pin bores aligned along a pin bore axis for receipt of a wrist pin;

one of an open outer cooling gallery forming a portion of said undercrown surface, a sealed outer cooling gallery forming a portion of said undercrown surface, or an outer galleryless region forming a portion of said undercrown surface, and additionally a central undercrown surface forming another portion of said undercrown surface;

an insulating coating applied to at least one of said portions of said undercrown surface, the insulating coating including at least one of ceria, ceria stabilized zirconia, and a mixture of zirconia stabilized by ceria and zirconia stabilized by yttria; the at least one of ceria, ceria stabilized zirconia, and the mixture of zirconia stabilized by ceria and zirconia stabilized by yttria being present in an amount of 90 to 100 wt. %, based on the total weight of said insulating coating; and a metal-based bond material, separate from said insulating coating, sandwiched between the metal piston body and the insulating coating to facilitate bonding the insulating coating to the metal piston body, wherein the metal-based bond material forms a gradient transitioning from a first portion that is 100% made of said metal-based bond material to a second portion that is 100% made of said insulating coating and an intermediate portion between the first portion and the second portion has some of the metal-based bond material and some of the insulating coating.

2. The piston of claim 1, wherein said insulating coating has a thermal conductivity which is lower than the thermal conductivity of said metal piston body.

3. The piston of claim 1, wherein the insulating coating includes the ceria in an amount of 90 to 100 wt. %, based on the total weight of the insulating coating.

4. The piston of claim 1, wherein the insulating coating includes the ceria stabilized zirconia in an amount of 90 to 100 wt. %, based on the total weight of the insulating coating.

5. The piston of claim 1, wherein the insulating coating includes the zirconia stabilized by ceria and the zirconia stabilized by yttria in an amount of 90 to 100 wt. %, based on the total weight of the ceramic-based material.

6. The piston of claim 5, wherein about 50 wt. % of the zirconia is stabilized by ceria and about 50 wt. % of the zirconia is stabilized by yttria, based on the total weight of the insulating coating.

7. The piston of claim 1, wherein the metal-based bond material is formed from the same type of metal as said metal piston body.

8. The piston of claim 1, wherein the metal-based bond material is formed from a superalloy.

9. The piston of claim 1, wherein the insulating coating has a thermal conductivity less than 1 W/m·K.

10. The piston of claim 1, wherein the piston has said open outer cooling gallery with an inlet configured for oil to be sprayed in the open outer cooling gallery and an outlet configured for the oil to exit the open outer cooling gallery, wherein said insulating coating is applied to at least a portion of said open outer cooling gallery.

11. The piston of claim 1, wherein the piston has said sealed outer cooling gallery, wherein said insulating coating is applied to at least a portion of said sealed outer cooling gallery.

12. The piston of claim 1, wherein the piston has said outer galleryless region, wherein said insulating coating is applied to at least a portion of said outer galleryless region.

13. A method of manufacturing a piston for an internal combustion engine, comprising:

forming a metal piston body extending along a central longitudinal axis along which the piston reciprocates in a cylinder bore of the internal combustion engine;

forming the metal piston body having an upper combustion wall providing an upper combustion surface configured for direct exposure to combustion gases within the cylinder bore and providing an undercrown surface opposite the upper combustion surface, and further providing an annular ring belt region depending from the upper combustion surface for receipt of at least one piston ring;

forming a pair of skirt panels depending from the ring belt region to facilitate guiding the piston within the cylinder bore;

forming a pair of pin bosses depending from the undercrown surface, the pin bosses providing a pair of laterally spaced pin bores aligned along a pin bore axis for receipt of a wrist pin;

forming one of an open outer cooling gallery providing a portion of the undercrown surface, a sealed outer cooling gallery providing a portion of the undercrown surface, or an outer galleryless region providing a portion of the undercrown surface, and additionally a central undercrown surface providing another portion of the undercrown surface;

applying an insulating coating including at least one of ceria, ceria stabilized zirconia, and a mixture of zirconia stabilized by ceria and zirconia stabilized by yttria to at least one of the portions of the undercrown surface, the at least one of ceria, ceria stabilized zirconia, and the mixture of zirconia stabilized by ceria and zirconia stabilized by yttria being present in an amount of 90 to 100 wt. %, based on the total weight of said insulating coating; and applying a metal-based bond material in sandwiched relation between the metal piston body and the insulating coating to facilitate bonding the insulating coating to the metal piston body and applying the metal-based bond material to form a gradient transitioning from 100% metal-based bond material to a 100% of said insulating coating wherein the gradient includes an intermediate portion which includes both the metal-based bond material and the insulating coating.

14. The method of claim 13, further including providing the insulating coating having a thermal conductivity which is lower than the thermal conductivity of the metal piston body.

15. The method of claim 13, further including providing the insulating coating including the ceria in an amount of 90 to 100 wt. %, based on the total weight of the insulating coating.

16. The method of claim 13, further including providing the insulating coating including the ceria stabilized zirconia in an amount of 90 to 100 wt. %, based on the total weight of the insulating coating.

17. The method of claim 13, further including providing the insulating coating including the zirconia stabilized by ceria and the zirconia stabilized by yttria in an amount of 90 to 100 wt. %, based on the total weight of the insulating coating.

18. The method of claim 17, further including providing about 50 wt. % of the zirconia being stabilized by ceria and about 50 wt. % of the zirconia being stabilized by yttria, based on the total weight of the insulating coating.

19. The method of claim 13, further including providing the metal-based bond material being formed from the same type of metal as the metal piston body.

20. The method of claim 13, further including providing the metal-based bond material being formed from a superalloy.

21. The method of claim 13, further including providing the insulating coating having a thermal conductivity less than 1 W/m·K.

22. The method of claim 13, further including forming the piston having said open outer cooling gallery with an inlet configured for oil to be sprayed in the open outer cooling gallery and an outlet configured for the oil to exit the open outer cooling gallery, and applying the insulating coating to at least a portion of the open outer cooling gallery.

23. The method of claim 13, further including forming the piston having said sealed outer cooling gallery, and applying the insulating coating to at least a portion of the sealed outer cooling gallery.

24. The method of claim 13, further including forming the piston having said outer galleryless region, and applying the insulating coating to at least a portion of the outer galleryless region.

* * * * *